US007428400B2

(12) United States Patent
Iwakura et al.

(10) Patent No.: US 7,428,400 B2
(45) Date of Patent: Sep. 23, 2008

(54) PRIMARY TRANSFER UNIT OF IMAGE FORMING APPARATUS

(75) Inventors: Yoshie Iwakura, Osaka (JP); Akihiro Kawasaki, Hyogo (JP); Atsushi Takehara, Kyoto (JP); Takafumi Miyazaki, Osaka (JP); Tomoya Adachi, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 264 days.

(21) Appl. No.: 11/276,377

(22) Filed: Feb. 27, 2006

(65) Prior Publication Data

US 2006/0210327 A1 Sep. 21, 2006

(30) Foreign Application Priority Data

Mar. 18, 2005 (JP) ..... 2005-080713

(51) Int. Cl.
*G03G 15/20* (2006.01)
*G03G 15/01* (2006.01)

(52) U.S. Cl. ..... 399/313; 399/302

(58) Field of Classification Search ..... 399/66, 399/297, 299, 302, 303, 313, 314
See application file for complete search history.

(56) References Cited

U.S. PATENT DOCUMENTS

| | | | |
|---|---|---|---|
| 6,249,304 | B1 | 6/2001 | Sawayama et al. |
| 6,292,206 | B1 | 9/2001 | Takehara et al. |
| 6,295,438 | B1 | 9/2001 | Fujishiro et al. |
| 6,334,039 | B1 | 12/2001 | Yoshinaga et al. |
| 6,366,754 | B1 | 4/2002 | Sato et al. |
| 6,782,227 | B2 | 8/2004 | Ishibashi et al. |
| 7,003,238 | B2 | 2/2006 | Yoshida et al. |
| 2004/0109709 | A1 | 6/2004 | Ishibashi et al. |
| 2004/0156653 | A1 | 8/2004 | Takehara |
| 2005/0013636 | A1 | 1/2005 | Sawai et al. |
| 2005/0141930 | A1 | 6/2005 | Murakami et al. |
| 2005/0147424 | A1 | 7/2005 | Kato et al. |
| 2005/0226651 | A1 | 10/2005 | Umezawa et al. |
| 2006/0210327 | A1 | 2/2006 | Iwakura et al. |

FOREIGN PATENT DOCUMENTS

| | | |
|---|---|---|
| EP | 1 351 100 A1 | 10/2003 |
| JP | 10-10876 | 1/1998 |
| JP | 11-38796 | 2/1999 |
| JP | 2004-145187 | 5/2004 |

OTHER PUBLICATIONS

U.S. Appl. No. 10/666,256, filed Sep. 22, 2003, Takehara.
U.S. Appl. No. 11/276,377, filed Feb. 27, 2006, Iwakura et al.
U.S. Appl. No. 11/855,739, filed Sep. 14, 2007, Fuwa et al.

*Primary Examiner*—Hoang Ngo
(74) *Attorney, Agent, or Firm*—Oblon, Spivak, McClelland, Maier & Neustadt, P.C.

(57) ABSTRACT

A primary transfer unit includes transfer units for performing a toner transfer from image carriers onto a transfer belt. Each of the transfer units is formed with a metallic roller. The metallic roller is arranged so as to satisfy $\theta 1<\theta 2$, where an angle of the endless belt with respect to a tangent to the image carrier, on a side upstream of rotation of the endless belt to a transfer nip region where the image carrier and the endless belt are in contact is $\theta 1$, and an angle of the endless belt with respect to the tangent, on a side downstream of rotation of the endless belt to the transfer nip region is $\theta 2$.

2 Claims, 2 Drawing Sheets

PRIMARY TRANSFER UNIT OF IMAGE FORMING APPARATUS

CROSS-REFERENCE TO RELATED APPLICATIONS

The present document incorporates by reference the entire contents of Japanese priority document, 2005-080713 filed in Japan on Mar. 18, 2005.

BACKGROUND OF THE INVENTION

1. Field of the Invention

The present invention relates to an image forming apparatus using electrophotography.

2. Description of the Related Art

For color image forming apparatuses, techniques for reducing hollow defects of characters and thin lines caused at a primary transfer unit have been developed. In a technique disclosed in Japanese Patent Application Laid-Open No. H10-10876, an entrance/exit angle of a belt of a primary transfer unit is differed at an upstream side and a downstream side of rotation. When the transfer unit is a corotron, the transfer unit is arranged not to contact a photosensitive element, and the belt is arranged to make contact with the photosensitive element by applying tension. Because toner transfer is carried out by the transfer unit in a non-contact condition, a press-contact force of the belt is low, and deterioration of image quality caused by, for example, hollow defect of thin lines, is reduced. In addition, since the tension angle is differed at the upstream side and the downstream side, toner scattering before transfer nipping is reduced.

In a technique disclosed in Japanese Patent Application Laid-Open No. H11-38796, a transfer roller is arranged at a downstream side to a photosensitive element, and an auxiliary roller is arranged at a downstream side to the transfer roller, paper that has arrived by being conveyed on the belt can be satisfactorily separated without winding around the photosensitive element. Therefore, a sufficient transfer efficiency can be obtained.

In a technique disclosed in Japanese Patent Application Laid-Open No. 2004-145187, a primary transfer roller is arranged being shifted from a position directly under a photosensitive element, and a voltage is supplied from an identical power supply, unevenness in speed of a belt is reduced. Thus, deterioration in image quality is prevented.

However, if the corotron is used, an amount of ozone emissions is large, which is problematic from a point of view of environmental protection. Moreover, since there are tension rollers in the front and in the rear of a transfer point, a size and cost of the apparatus increase.

In the technique disclosed in Japanese Patent Application Laid-Open No. H11-38796, a toner is directly transferred to a paper from the photosensitive element so that separation thereof is efficiently carried out. However, it is greatly apart from a construction and a purpose of the present invention. Even if a transfer roller is arranged an at a downstream side to the photosensitive element to improve transfer performance, it is disadvantageous since there is a tension roller at a further downstream side to the transfer roller, a size and cost of the apparatus increases.

In the technique disclosed in Japanese Patent Application Laid-Open No. 2004-145187, by providing voltage for a primary transfer from an identical power supply, improvement in belt conveying performance is intended. However, there is no description of an effect on transfer performance itself. Generally, the more downstream side a transfer is carried out, the higher transfer voltage is applied so that a stable toner transfer is achieved. Since the voltage is provided only by the identical power supply, it is considered that transfer performance and transfer efficiency at the downstream side are lowered.

SUMMARY OF THE INVENTION

The other objects, features, and advantages of the present invention are specifically set forth in or will become apparent from the following detailed description of the invention when read in conjunction with the accompanying drawings.

DETAILED DESCRIPTION OF THE PREFERRED EMBODIMENTS

Exemplary embodiments according to the present invention will be explained in detail below with reference to the accompanying drawings. In the explanation, although detailed designations of members are used for ease in understanding the invention, these designations by no means limit the scope of applicability of the invention.

Figure 1:
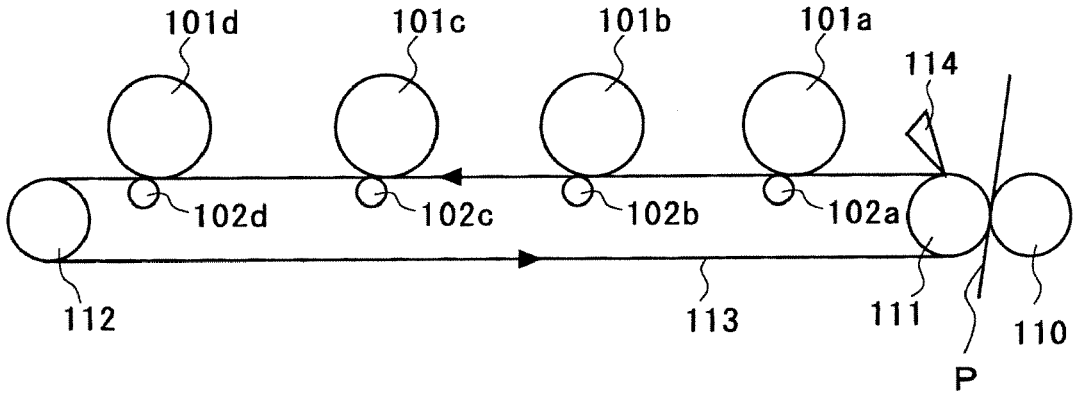
FIG. 1 is a schematic of an image forming apparatus according to an embodiment of the present embodiment.

FIG. 1 is a schematic of an image forming apparatus according to an embodiment of the present invention including a transfer unit. The image forming apparatus includes an image carrier 101 and a primary transfer roller 102 that is disposed on an intermediate transfer belt 113 formed in an endless belt. The image carrier 101 includes four image carriers 101*a* to 101*d*, and the primary transfer roller 102 includes four metallic rollers 102*a* to 102*d*. The primary transfer roller 102 includes metallic rollers and configured to form a color image on the intermediate transfer belt (transfer belt) 113.

As shown in FIG. 1, the intermediate transfer belt 113 is wound on two rollers of a driving roller 111 and a tension roller 112 arranged opposite. The intermediate transfer belt 113 is rotated in a direction (clockwise) indicated by an arrow shown in FIG. 1. The driving roller 111 is arranged opposite a secondary transfer roller 110 and also has a function as an opposing roller to a cleaning blade 114 that removes residual toner.

More specifically, the driving roller 111 and the tension roller 112 support the intermediate transfer belt 113 while applying tension. By applying a predetermined voltage to the metallic rollers 102*a* to 102*d* from an upstream side in a travelling direction of the intermediate transfer belt 113, respective colors are overlayed on the intermediate transfer belt 113 so as to form a color image.

In addition, the formed color image is transferred to paper P as a transfer material by applying a predetermined voltage to the secondary transfer roller 110, and is output after being fixed (unillustrated). A toner that could not be transferred by the secondary transfer roller 110 and remains on the intermediate transfer belt 113 is collected into a cleaner unit (unillustrated) by the cleaning blade 114.

As the material of the intermediate transfer belt 113, polymeric materials such as thermoplastic elastomer alloy (TPE), polycarbonate (PC), polyimide (PI), polyamide alloy (PAA), and polyvinylidene fluoride (PVDF) can be mentioned. For the material of the secondary transfer rollers 110, an elastic roller is suitable, and as materials thereof, an ion conductive roller (urethane+carbon dispersion, acrylonitrile-butadiene rubber (NBR), hydrin), an electron conducting type roller (EPD), and the like are dominant.

The primary transfer roller 102 is arranged at a downstream side with respect to a perpendicular line that drops from the image carrier 101 and at the image carrier 101 side to obtain a stable transfer nip width. Since the primary transfer roller 102 and image carrier 101 are arranged so that a distance between the centers is greater than a sum of the radiuses of these, the outer circumference of the primary transfer roller 102 does not make contact with the image carrier 101 when the intermediate transfer belt 113 is not interposed.

Thereby, a pressure applied to the image carrier 101 during a primary transfer is only tension of the belt, which allows realizing a lower pressure. In addition, since an air-gap electric field E that is applied in the vicinity of an entrance of a transfer nip between the first transfer roller 102 and image carrier 101 can be lowered by arranging the primary transfer roller 102 at a downstream side with respect to the image carrier 101, it becomes possible to prevent a pre-transfer electric discharge, which prevents a scattering image and allows realizing a higher image quality with a high sharpness.

In other words, as a positional relationship between the primary transfer roller 102 and image carrier 101, when an angle created by a tangent line at a point where a perpendicular line that drops from the image carrier intersects the image carrier 101, and from a transfer nip region 115 where the image carrier 101 and intermediate transfer belt 113 are in contact, the intermediate transfer belt 113 at an upstream-side entrance of the transfer nip is provided as $\theta 1$, and an angle created by the tangent line and intermediate transfer belt 113 at a downstream-side exit of the transfer nip is provided as $\theta 2$, the primary transfer roller 102 is arranged so that $\theta 1<\theta 2$. Thereby, the configuration can be realized, and an image forming apparatus that can realize a high image quality by a simple and inexpensive configuration can be provided.

The respective angles are optimally $0° \leqq \theta 1 \leqq 10°$ and $20° \leqq \theta 2 \leqq 40°$. When $\theta 1$ is less than 0°, since winding around the image carrier 101 is reduced in the vicinity of the transfer nip entrance, a pre-transfer electric discharge occurs depending on a set primary transfer voltage, resulting in degradation of image quality. At an angle over 10°, since the transfer nip 115 in a region uninvolved in a static transfer of toner at the upstream side is increased and only the amount of winding around the image carrier is increased, the intermediate transfer belt 113 and image carrier 101 electrostatically adsorb each other and travelling performance of the belt becomes unstable, therefore, this results in inferior image quality including displacement of thin lines and the like.

On the other hand, when $\theta 2$ is less than 20°, since a sufficient transfer nip cannot be obtained, contact between the intermediate transfer belt 113 and image carrier 101 becomes unstable, which causes an image defect and a transfer failure. When $\theta 2$ is equal to or more than 40°, the amount of winding between the intermediate transfer belt 113 and primary transfer roller 102 is increased, a curvature of winding of the intermediate transfer belt 113 onto the primary transfer roller 102 is increased, which accelerates shortening of a belt life such as a belt end crack. Accordingly, $0° \leqq \theta 1 \leqq 10°$ and $20° \leqq \theta 2 \leqq 40°$ are optimal values.

Figure 3:
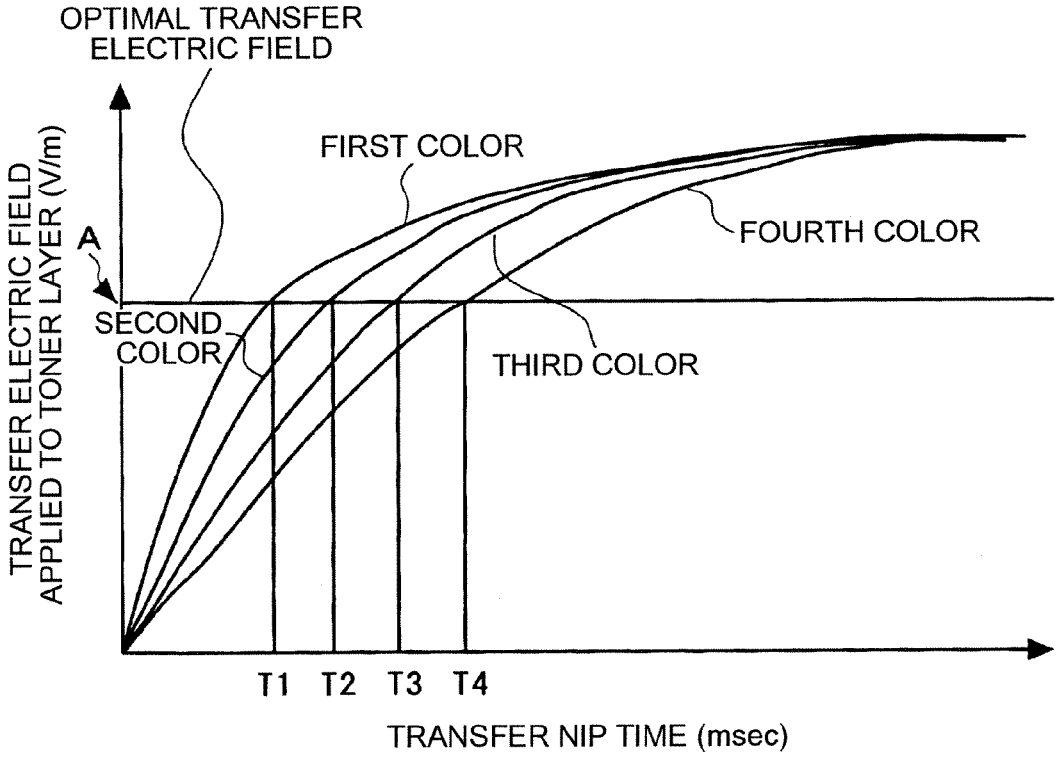
FIG. 3 is a graph of values of transfer electric fields applied to a primary-transfer toner layer according to the embodiment.

Schematically plotted values of transfer electric fields of a first color to a fourth color applied to the inside of a primary-transfer toner layer when a primary transfer is carried out at an identical voltage are shown in FIG. 3. When an equivalent circuit of a primary transfer unit including a toner layer that is solved in terms of a transfer nip passing time and a transfer electric field within the toner layer, an exponential function is provided, and characteristics thereof are as in FIG. 3 in terms of time. Reference symbol A denotes a transfer electric field that is necessary for the transfer belt 113 to obtain high transfer efficiency.

Namely, for obtaining high transfer efficiency, an optimal applied voltage and a stable transfer nip (time) are required. Even at an identical voltage, a transfer electric field necessary for transfer can be sufficiently obtained by controlling the transfer nip time. Since the first color has a single layer as a toner layer, a rise of the transfer electric field within the toner layer from the vicinity of the transfer nip entrance is quick, and it also quickly reaches a satiation potential (electric field). On the other hand, for the fourth color, since toners of previous colors have already been transferred on the belt, it takes time to reach a satiation potential (electric field). Therefore, by increasing the nip time, a stable transfer electric field can be sufficiently obtained. In other words, when transfer is carried out at an identical voltage, transfer characteristics the same as those of the first color can be obtained by increasing the transfer nip time at the downstream side.

Figure 2:
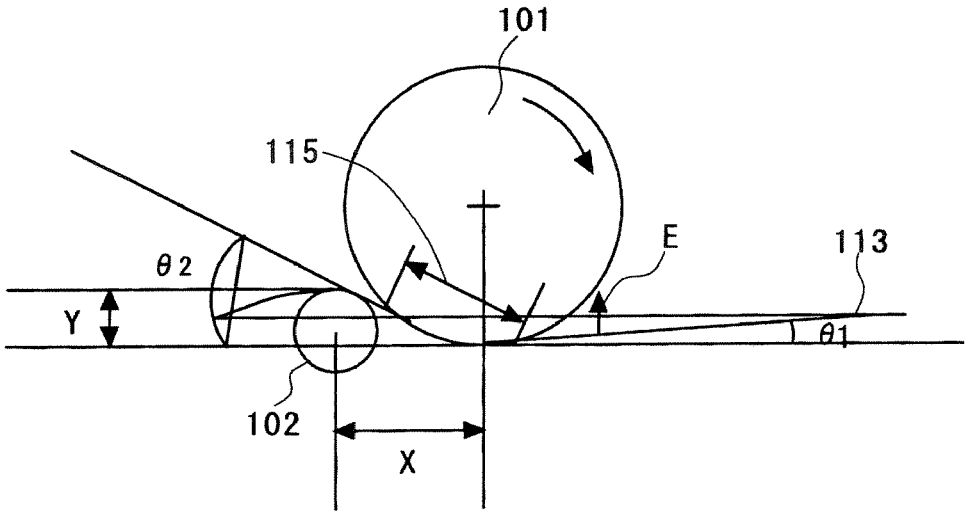
FIG. 2 is a schematic for illustrating a primary transfer in the image forming apparatus.

For example, in FIG. 2, when an intermediate transfer belt 113 having a surface resistance of $10^9\Omega/\square \sim 10^{11}\Omega/\square$ (Mitsubishi Hiresta 500 volts (V), applied for 10 seconds) and a volume resistance of $10^9\Omega/\square \sim 10^{11}\Omega/\square$ (Mitsubishi Hiresta 500 V, applied for 10 seconds), the image carrier 101 having a diameter $\phi 24$, and a primary transfer roller 102 having a diameter $\phi 8$ are used, for the primary transfer nip amount, it can be considered to make the nip amount (nip time) greater as it is further at the downstream side by providing the first color: X=7 millimeters (mm), Y=0.5 mm, the second color: X=7.5 mm, Y=1 mm, the third color: X=8 mm, Y=1 mm, and the fourth color: X=8.5 mm, Y=2 mm. However, without sticking to the numerical values described above, an optimal value of the nip amount (nip time) varies depending on the resistance of the intermediate transfer belt 113 and diameters of the respective components, and a nip amount varying method is not limited to the method described above.

According to the embodiments described above, it is possible to sufficiently obtain a transfer margin to realize high transfer efficiency, and to reduce hollow defects of characters and thin lines, thereby reproducing a high-quality image.

Moreover, according to the embodiments described above, it is possible to reduce toner scattering, thereby providing an image with high sharpness without deteriorating resolution.

Furthermore, according to the embodiments described above, it is possible to reduce cost.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a primary transfer unit including a plurality of image carriers configured to carry an image;

an endless belt on which a color image is formed, the color image formed by a toner transfer from each of the image carriers onto the endless belt; and a secondary transfer unit configured to transfer the color image to a transfer material, wherein the primary transfer unit further includes a transfer unit to perform the toner transfer, the transfer unit formed with a metallic roller arranged near each of the image carriers, the endless belt is arranged to run through between each of the image carriers and each metallic roller, and the metallic roller is arranged so as to satisfy $\theta 1 < \theta 2$, where an angle of the endless belt with respect to a horizontal tangent line of the image carrier, on a side upstream of rotation of the endless belt to a transfer nip region where the image carrier and the endless belt are in contact is $\theta 1$, and an angle of the endless belt with respect to the horizontal tangent line on a side downstream of rotation of the endless belt to the transfer nip region is $\theta 2$ and wherein to each metallic roller, a voltage distributed from an identical power supply is provided, and the endless belt is arranged such that a transfer nip region at an image carrier that is arranged downstream of rotation of the endless belt to another image carrier becomes wider.

2. The image forming apparatus according to claim 1, wherein the metallic roller is arranged at a side downstream of rotation of the endless belt to each of the image carriers.

* * * * *